US006932233B2

(12) United States Patent
Lesage

(10) Patent No.: US 6,932,233 B2
(45) Date of Patent: Aug. 23, 2005

(54) FUEL OIL TANK WITH EVACUATION CHANNEL

(75) Inventor: Claude Lesage, Pointe Claire (CA)

(73) Assignee: Les Reservoirs de L'Estrie, Granby (CA)

( * ) Notice: Subject to any disclaimer, the term of this patent is extended or adjusted under 35 U.S.C. 154(b) by 118 days.

(21) Appl. No.: 10/308,017

(22) Filed: Dec. 3, 2002

(65) Prior Publication Data

US 2004/0104234 A1 Jun. 3, 2004

(51) Int. Cl.[7] ..... B65D 88/02
(52) U.S. Cl. ..... 220/567; 220/567.2
(58) Field of Search ..... 220/601, DIG. 6, 220/567.2, 567; 222/185.1

(56) References Cited

U.S. PATENT DOCUMENTS 1,235,438 A * 7/1917 Chynoweth ..... 210/172
2,339,303 A * 1/1944 Franklin ..... 220/564
2,587,840 A * 3/1952 Gruetjen ..... 220/612
6,182,856 B1 * 2/2001 Berrenberg et al. ..... 220/771

* cited by examiner

*Primary Examiner*—Stephen Castellano
(74) *Attorney, Agent, or Firm*—Ogilvy Renault LLP; Guy J. Houle

(57) ABSTRACT

A fuel oil tank is comprised of a sealed reservoir having side walls, a top and bottom walls, and opposed end walls. A closable inlet port is provided to admit fuel oil in the reservoir. An outlet port is provided in the bottom wall and is adapted to receive a coupling to connect a feed pipe to supply fuel oil to a remote apparatus. The bottom wall has an evacuation channel formed in a lowermost part thereof to direct fuel oil from the lowermost part of the tank to the outlet port which is located in a base of the evacuation channel whereby any liquid in the fuel oil which is heavier than the fuel oil will be channeled to the outlet port and not accumulate in the lowermost part of the bottom wall of the tank where it would inhibit the formation of rust in the reservoir.

10 Claims, 2 Drawing Sheets

FUEL OIL TANK WITH EVACUATION CHANNEL

TECHNICAL FIELD

The present invention relates to a fuel oil tank and more particularly, but not exclusively, to a domestic fuel oil tank constructed in such a way that it will prevent water from accumulating therein which causes the formation of rust and shorten the life of the reservoir.

BACKGROUND ART

Domestic fuel oil tank of the prior art are usually provided with an outlet tap close to the bottom wall of the reservoir and positioned in one of the end walls. The tap provides a shut-off for the fuel and a connection to a fuel line to supply fuel oil to a fuel burning apparatus. The outlet pipe enters the reservoir above the bottom wall. Accordingly, such reservoirs have been known to accumulate water therein due to condensation, rain or other reasons and these reservoirs are usually mounted outside or in basements of buildings.

Because water is heavier than fuel oil it accumulates at the bottom of the tank and makes the tank rust in that area particularly around the coupling for the outlet pipe and joints. Also, because fuel oil contains an admixture of chemicals it also inhibit rust formation. Some of these chemicals may contain sulfur which when mixed with water acts like an acid and accordingly accelerates the rusting process. Another disadvantage is that as water accumulates and stagnates at the bottom of the reservoir it could eventually reach the level of the outlet pipe and large quantities of water may then flow in the supply line and extinguish the burner of the apparatus being fed.

Another disadvantage of fuel oil reservoir is that they provide an environmental problem in that they pollute the soil. For those reservoirs that are installed inside buildings they usually cause spills on the concrete and the oil impregnates the concrete causing odors and stains which are difficult to remove. Another disadvantage of fuel oil reservoirs is that when installed inside buildings they are often disposed at an angle. Therefore, the feed pipes which connect to the exterior of the building to supply fuel oil to the reservoir need to be bent and this causes solder joints to crack.

The solution to the above-mentioned problems is that reservoirs are being constructed of thicker steel to guarantee a 10 year life. The result of this is that they are heavier to carry and more costly and they do not prevent water from accumulating in the reservoir nor do they solve the problem of the feed pipes as mentioned hereinabove. Most fuel oil tanks are also awkward to transport and manoeuver.

SUMMARY OF INVENTION

It is a feature of the present invention to provide a domestic fuel oil tank constructed in such a way as to overcome the above-mentioned disadvantages of the prior art and wherein liquids heavier than the fuel oil will not accumulate in the lower portion of the reservoir but will be evacuated as they propagate to the bottom of the tank.

Another feature of the present invention is to provide a domestic fuel oil tank having improved longitivity, which is easy to transport and maneuver and which is substantially leak-proof and easy to manufacture.

According to the above features, from a broad aspect, the present invention provides a fuel oil tank which comprises a sealed reservoir having sidewalls, a top and bottom wall, and opposed end walls. A closable inlet port is provided to admit fuel oil in the reservoir. An outlet port is provided in the bottom wall and is adapted to receive a coupling to connect a feed pipe to supply fuel oil to a remote fuel burning apparatus. The bottom wall has a cavitated evacuation means formed in the lowermost part thereof to direct fuel oil from the lowermost part to the outlet port which is located in the lowermost part whereby any liquid in the fuel oil, which is heavier than the fuel oil, will be directed to the outlet port and not accumulate in the lowermost part of the bottom wall where it would inhibit the formation of rust in the reservoir.

BRIEF DESCRIPTION OF DRAWINGS

The preferred embodiments of the present invention will now be described with reference to the accompanying drawings in which.

DESCRIPTION OF PREFERRED EMBODIMENTS

Figure 1:
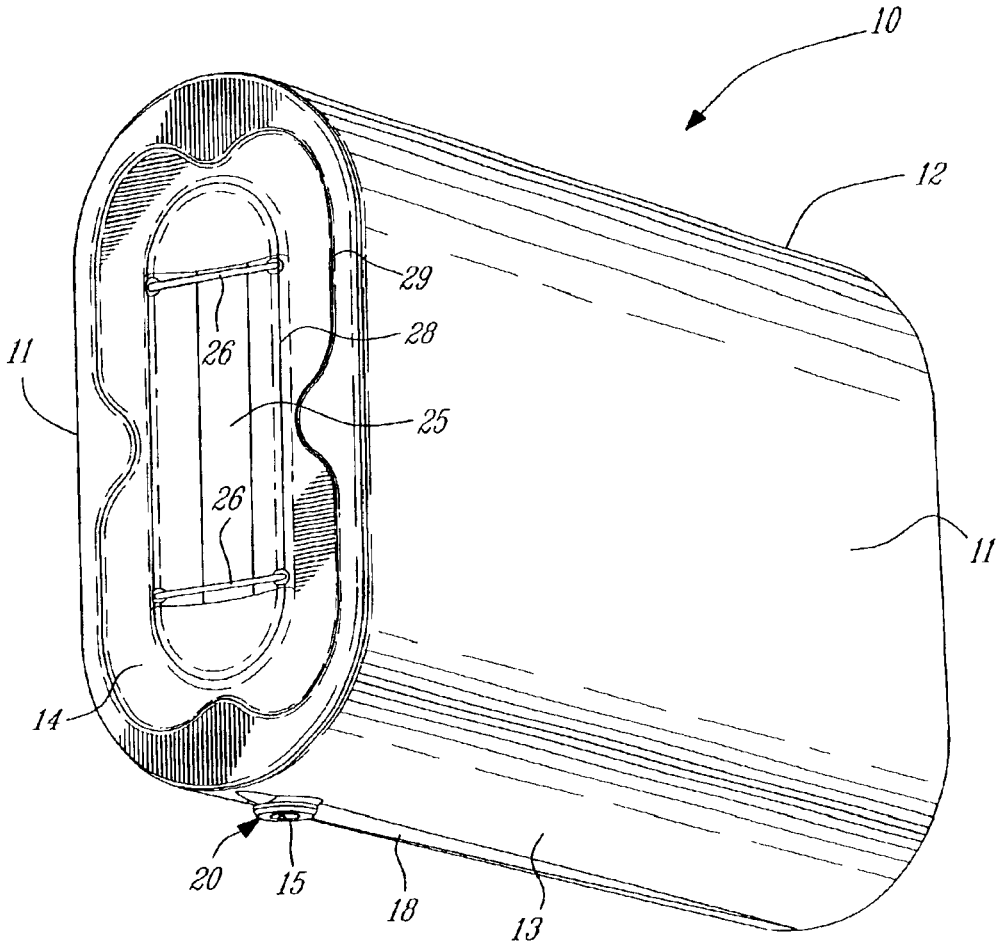
FIG. 1 is a perspective view of the domestic fuel oil tank of the present invention.

Referring now to the drawings and more particularly to FIG. 1, there is shown generally at 10 a domestic fuel oil tank constructed in accordance with the present invention. The tank 10 is a sealed reservoir defined by side walls 11, a top wall 12, a bottom wall 13, and opposed end walls 14. An outlet port 15 is provided in the bottom wall and is adapted to receive a coupling 16 (see FIG. 3) to connect a feed pipe 17 to supply fuel oil to a remote fuel burning apparatus, not shown. A closeable intlet coupling 40 is provided in the top wall 12 to admit fuel oil in the reservoir.

As more clearly illustrated in FIGS. 2 and 4 the bottom wall 13 is provided with an elongated evacuation channel 18 formed in a lowermost part thereof whereby to direct fuel oil from the lowermost part of the outlet port which is located in a base of the evacuation channel whereby any liquid in the fuel oil, which is heavier than the fuel oil, will be channeled to the outlet port 15 and not accumulate in the lowermost part of the bottom wall which is illustrated by reference numeral 13' in FIG. 2. With the prior art when water accumulates in this lower part of the reservoir, it inhibited the formation of rust in the reservoir and particularly along the joints formed by the outlet tap usually located at the base of the end wall. Rust also formed along welded or press fit metal joints.

Figure 2:
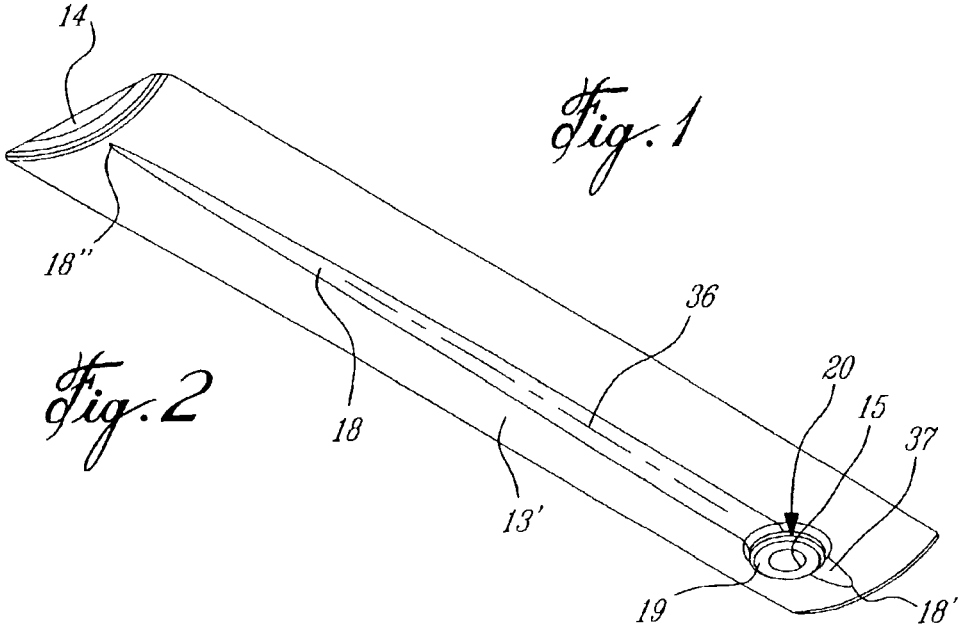
FIG. 2 is a fragmented view showing a portion of the bottom wall of the fuel oil tank and illustrating the shape and location of the evacuation channel formed therein.
Figure 4:
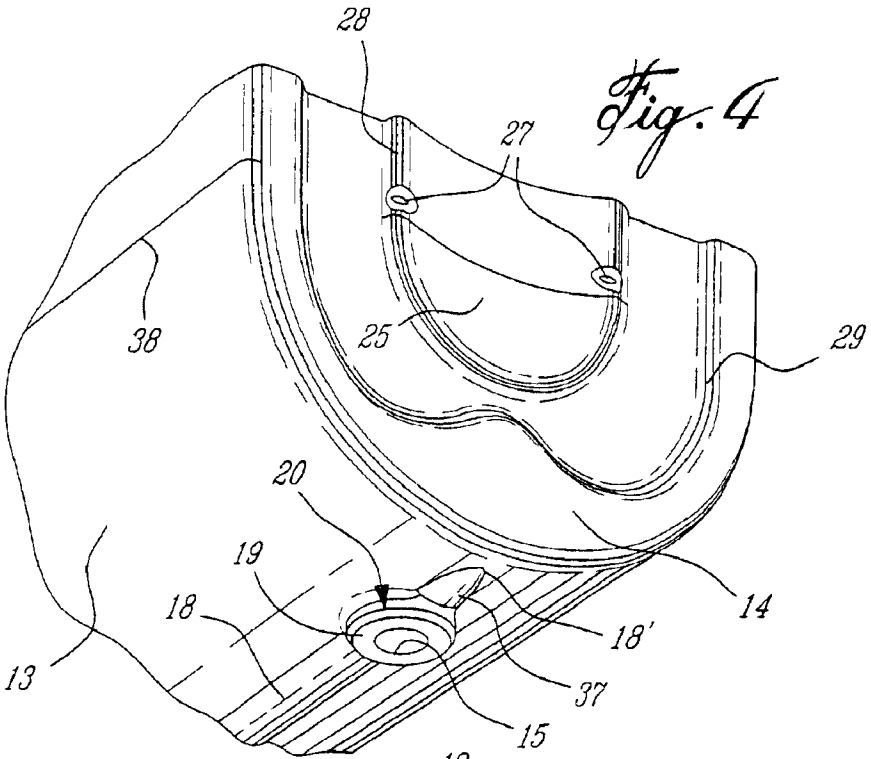
FIG. 4 is an enlarged fragmented view showing the position of the channel and its nipple formation as well as the construction of the end wall.

As shown in FIGS. 1, 2 and 4 the evacuation channel 18 is a tapered channel sloping to the outlet port 15. As hereinshown, the outlet port 15 is located in a base 19 of the channel and is shaped as a flat enlarged nipple formation 20. This flat enlarged nipple formation 20 is disposed spaced from one of opposed ends of the channel, herein end 18'. The channel also slopes from its opposed ends 18' and 18" to the flat enlarged nipple formation whereby any liquid heavier than fuel oil will descend towards the bottom wall and locate within the channel. When fuel oil is removed from the tank it creates a current within the channel which directs the heavier liquid droplets towards the outlet port 15 to be mixed with the fuel oil and burned by the burner associated with the remote apparatus being fed the fuel oil. Because the heavier liquid particles do not have time to accumulate they are evacuated as droplets and do not affect the burner but are simply evaporated by the hot flame and evacuated through the flues of the remote fuel burning apparatus as steam.

As also shown in these drawings, the evacuation channel 18 is widest at the flat enlarged nipple formation 20 and diminishes in width to a point at its opposed ends 18' and 18". At these points the channel also meets the plane of the bottom walls and accordingly the depth of the channel increases from the end 18' and 18" to the base 19 which contains the nipple formation.

Figure 5:
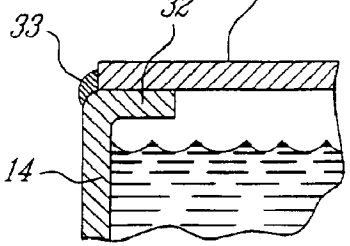
FIG. 5 is a fragmented section view showing how the end wall is press fit within the surrounding side walls, bottom wall and top wall and sealed therewith by a weld.
Figure 3:
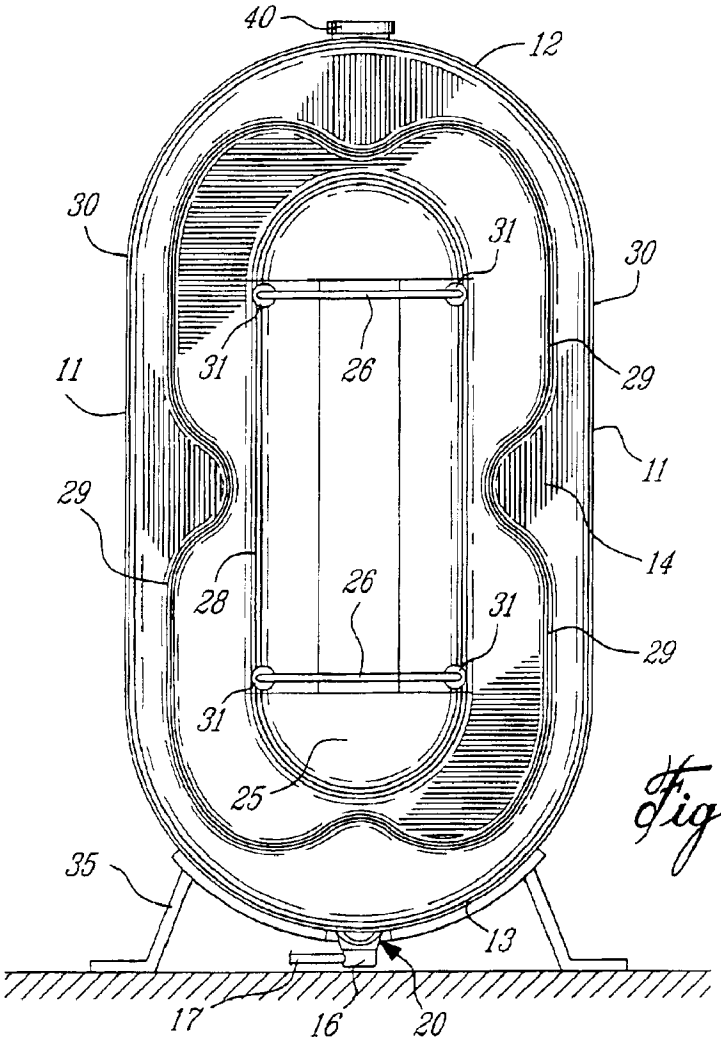
FIG. 3 is an end view of the fuel oil tank showing the construction of an end wall and the location of the nipple formation formed in the base of the channel with respect to the bottom wall of the reservoir.

With reference now to FIGS. 1, 3, and 5 there will be described the construction of the end walls 14. The tank sidewalls, top wall and bottom wall are formed from metal sheet sections usually steel, which are bent to size and welded along seams, such as longitudinal seam 38, as shown if FIG. 4. The end walls are metal stampings and are provided with a cavity 25 formed and shaped to give an aesthetic appearance to the tank and to strengthen the end walls. The cavity 25 is a concave cavity in the outer surface of the end wall and handle bars 26 are welded at specific locations and to structural indentations 27 formed in an endless rib 28 stamped within the end wall. The rib 28 is of substantially oval configuration and provides reinforcement of the end wall. As well, an outer ridge 29 also reinforces the end wall and closer to its outer periphery 30. Accordingly, thinner gauge steel may be used to construct the tank. The handle bars 26 are spot welded at 31 in the indentations 27. These handle bars provide for the transport of the tank form opposed ends thereof. This is particularly useful when installing and removing a tank from its location or maneuvering the tank in stairwells, etc.

As shown in FIG. 5 the end wall 14 is press fitted between the side walls, top wall and bottom wall with an outer flange portion 32 being forced in close frictional contact with the contour walls of the tank. A weld 33 is then formed at the joint.

As shown in FIG. 3 the fuel oil tank is shown horizontally supported by a cradle 35 which is secured to a floor surface. Of course, there is a multitude of supports for such fuel oil tanks and some are merely mounted on blocks when such a tank is located outside. Therefore, the tank is not always disposed on a true vertical axis but may be slightly angulated. This is the reason for the evacuation channel 18 extending centrally along the bottom wall 13 and along its central longitudinal axis 36 and having an enlarged base 19, as shown in FIG. 2. Accordingly, with the shape of the evacuation channel and the nipple formation 20 any water accumulating in the fuel oil will still be captured by the channel and the base 19 to exit the outlet port 15. Further, if the tank 10 is mounted inclined forwardly which is often the case to direct all the fuel oil to the outlet port, the front end portion 37 of the channel would still direct these water particles to the outlet. Accordingly, as can be appreciated the location and shape of the channel and the location of the nipple formation and the base of the nipple formation are essential features of the present invention. Further, because of the water evacuation feature the tank can be fabricated of thinner gauge to guarantee an increased life span. By maintaining the thinner gauge the tank is less costly to fabricate and easier to transport and maneuver.

It is within the ambit of the present invention to cover any obvious modifications of the embodiments described herein, provided such modifications fall within the scope of the appended claims.

What is claimed is:

1. A fuel oil tank comprising a sealed reservoir having sidewalls, a top wall and bottom wall, and opposed end walls; a closeable inlet port to admit fuel oil in said reservoir, an outlet feed port in said bottom wall adapted to receive a coupling to connect a feed pipe to supply fuel oil to a remote fuel burning apparatus, said bottom wall having an evacuation channel formed in a lowermost part thereof and sloping to said outlet feed port, said evacuation channel being adapted to channel fuel oil from said lowermost part of said tank to said outlet feed port which is located in said lowermost part and any liquid in said fuel oil which is heavier than said fuel oil will be mixed with said fuel oil in droplets form and channeled to said outlet feed port and will not accumulate in said lowermost part of said bottom wall where it would inhibit the formation of rust in said reservoir, said feed pipe being adapted to feed said liquid droplets mixed with said fuel oil to a remote fuel burning apparatus, wherein said opposed end walls are metal stamped with a cavity formed in an outer surface thereof, and handle bars welded across said cavity to provide handle holds to transport said tank by grasping said handle holds from opposed end walls thereof, wherein said cavity is provided with a contour reinforcing rib formed thereabout to strengthened said end walls, said handle bars being welded to said rib on opposed sides of said cavity.

2. A fuel oil tank as claimed in claim 1 wherein said outlet feed port is located in a flat enlarged nipple formation formed in said base of said evacuation channel.

3. A fuel oil tank as claimed in claim 2 wherein said flat enlarged nipple formation is disposed spaced from one of opposed ends of said evacuation channel, said channel sloping from said opposed ends thereof to said flat enlarged nipple formation.

4. A fuel oil tank as claimed in claim 3 wherein said evacuation channel is widest at said flat enlarged nipple formation and diminishes in width to a point at said opposed ends.

5. A fuel oil tank as claimed in claim 1 wherein said opposed end walls of said reservoir are press fit between said sidewalls and top and bottom wall, and a weld about a press fit joint all about said opposed end walls.

6. A fuel oil tank as claimed in claim 1 wherein said fuel oil tank is adapted for horizontal support over a support surface, said evacuation channel being a straight channel extending substantially end-to-end of said bottom wall an disposed on a central longitudinal axis thereof.

7. A fuel oil tank as claimed in claim 1 wherein said liquid in said fuel oil is water, said water being evacuated as it propagates to said evacuation channel.

8. A fuel oil tank as claimed in claim 7 wherein said channel is dimensioned and configured to create a channeled flow of said fuel oil towards said outlet feed port whereby to entrain said water as it propagates into said evacuation channel when fuel oil is extracted from said reservoir through said outlet port.

9. A fuel oil tank as claimed in claim 1, wherein an outer reinforcing ridge is formed between said contour reinforcing rib and an outer periphery of said end walls.

10. A fuel oil tank as claimed in claim 3 wherein said flat enlarged nipple formation is disposed spaced from a front one of said one of said opposed ends of said evacuation channel a predetermined distance wherein a channel portion is defined between a front one of said end walls and said outlet feed port to channel any water in said fuel oil away from a joint of said front wall to prevent rust from forming therein particularly when said tank is tilted forwardly.

* * * * *